US007600587B1

(12) United States Patent
Keck

(10) Patent No.: US 7,600,587 B1
(45) Date of Patent: Oct. 13, 2009

(54) WEAR RESISTANT SLEEVE FOR SUB ASSEMBLY

(76) Inventor: Clark Barton Keck, 2339 1/2 A Rattle Snake Ct., Grand Junction, CO (US) 81503

( * ) Notice: Subject to any disclaimer, the term of this patent is extended or adjusted under 35 U.S.C. 154(b) by 0 days.

(21) Appl. No.: 12/051,759

(22) Filed: Mar. 19, 2008

(51) Int. Cl.
*E21B 17/10* (2006.01)

(52) U.S. Cl. ..... 175/325.4; 175/325.5; 166/241.6

(58) Field of Classification Search ..... 175/325.5, 175/325.1, 325.7, 325.4; 166/241.6
See application file for complete search history.

(56) References Cited

U.S. PATENT DOCUMENTS 3,054,647 A * 9/1962 Von Rosenberg ..... 175/325.4
3,978,933 A * 9/1976 Olson et al. ..... 175/325.2
3,993,368 A * 11/1976 Jurgens et al. ..... 175/325.4
4,277,869 A * 7/1981 Hartwell ..... 29/898.01
4,296,973 A * 10/1981 Hartwell ..... 175/325.4

* cited by examiner

*Primary Examiner*—Kenneth Thompson
(74) *Attorney, Agent, or Firm*—Buskop Law Group, PC; Wendy Buskop

(57) ABSTRACT

An apparatus for protecting a sub assembly inside a borehole of a well, with a sleeve having a sleeve outer diameter larger than the body outer diameter; a plurality of offset indentations formed on the outer side of the sleeve formed in rows of 4 to 8 offset indentations along a diagonal orientation to a sleeve axis; a plurality of a metal carbide inserts providing an interference fit into each offset indentation thereby forming a wear resistant pad on the outer side of the sleeve; a sealing means disposed between the sleeve bottom beveled edge and the body forming a sealed sub assembly using at least two spring locking apparatus engaging locking indentations on the body.

8 Claims, 4 Drawing Sheets

WEAR RESISTANT SLEEVE FOR SUB ASSEMBLY

FIELD

The present embodiments relate to a removable, interchangeable, replaceable, wear pad for drill pipe, and bottom hole assemblies made of a sleeve with metal carbide inserts disposed on the sleeve.

BACKGROUND

A need exists for an inexpensive, easy to use device, that prevents casing wear, including drilling tubulars.

A further need exists for an easily replaceable device that is easy to use in the field, ease to remove and install, and does not fail easily during use.

The present embodiments meet these needs.

BRIEF SUMMARY OF THE INVENTION

A need exists for an inexpensive, replaceable, easy to use device, that prevents casing wear, including but not limited to the casing wear of drilling tubulars. The invention relates to a removable, interchangeable, replaceable wear pad for drill pipe and bottom hole assemblies made of a sleeve with metal carbide inserts disposed on the sleeve. The invention relates to a unique, reparable, and easily replaceable sleeve for use on a sub body inside a borehole of a well, such as a natural gas well and wells created and used for mining natural resources, an oil well, or even a water well.

The invention relates to an apparatus for protecting a sub assembly inside a borehole of a well, with a sleeve having a sleeve outer diameter larger than the body outer diameter; a plurality of offset indentations formed on the outer side of the sleeve formed in rows of 4 to 8 offset indentations along a diagonal orientation to a sleeve axis; a plurality of a metal carbide inserts providing an interference fit into each offset indentation thereby forming a wear resistant pad on the outer side of the sleeve; a sealing means disposed between the sleeve bottom beveled edge and the body forming a sealed sub assembly using at least two spring locking apparatus engaging locking indentations on the body.

BRIEF DESCRIPTION OF THE DRAWINGS

The detailed description will be better understood in conjunction with the accompanying drawings as follows.

Figure 1:
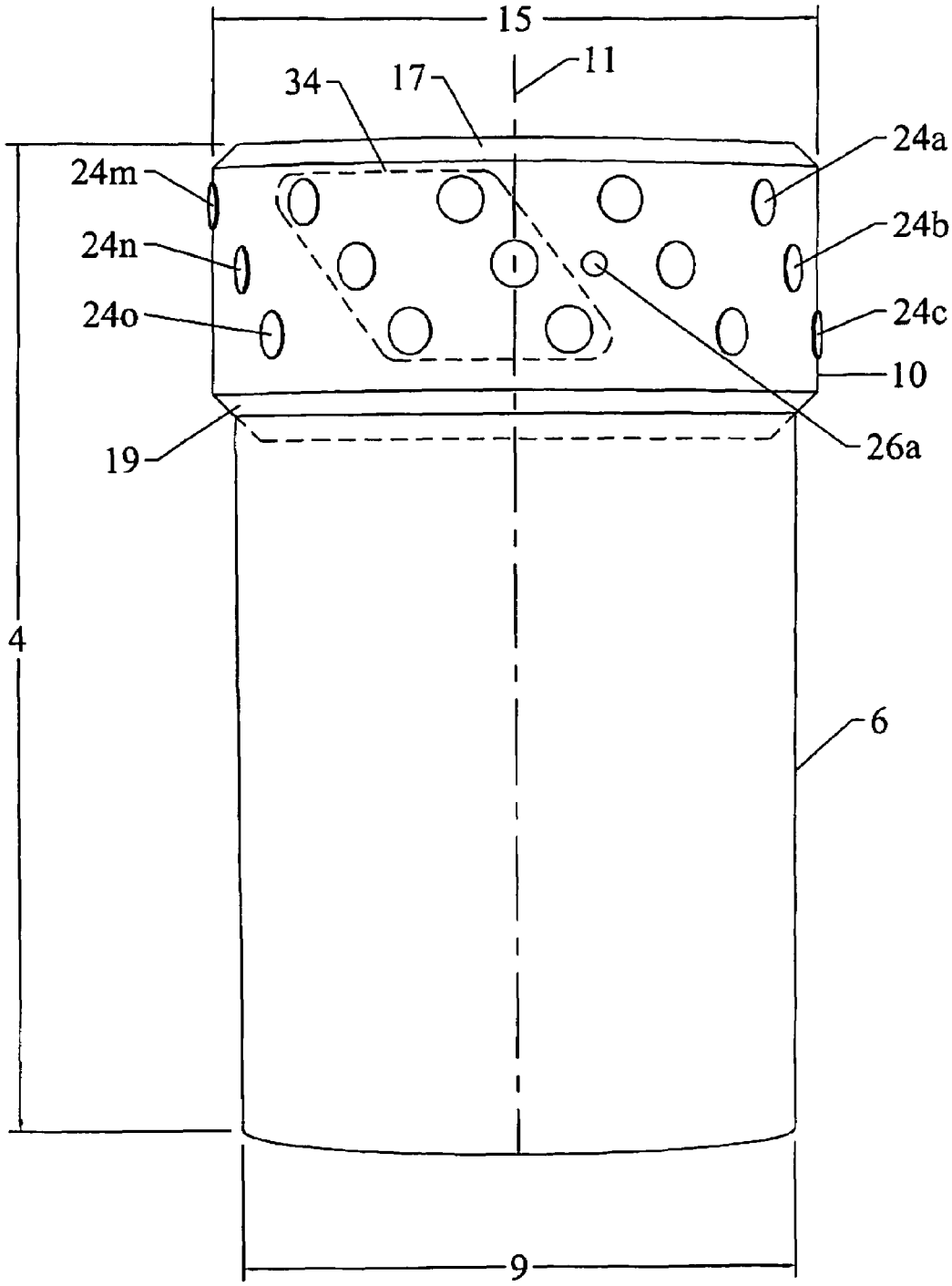
FIG. 1 depicts a side view of an embodiment of the invention engaging a body of a sub.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a device that is a unique reparable and easily replaceable sleeve for use on a sub body inside a borehole of a well such as a natural gas well, and wells created and used for mining natural resources, an oil well or even a water well.

The invention, known as a "casing saver" is made from a sleeve that can range in length from about 2 inches to about 10 inches, preferably 2.66 inches in length and have a wall thickness between about 0.4 inches to about 1.5 inches, and an inner diameter between about 4.5 inches and about 10 inches, preferably between about 6 inches and about 7 inches.

The sleeve can be longer than the above ranges, if use merits it, or even slightly shorter if needed. The sleeve had have a larger wall thickness up to 2 inches for very heavy drilling operations.

The sleeve has an inner side which slips over a body of a sub, so that the two form a wear protected sub assembly.

The sleeve can slip over milled drilling tubulars, but the invention requires the outer side of the sleeve being slightly larger than outer diameter of the body of the sub.

The sleeve separates the tubular or sub body from the walls of the well bore or from drilling muds or other fluids with or without particulate that flow in the well.

The sleeve is formed with a plurality of offset indentations that are oriented on a diagonal pattern, tangent to the axis of the sleeve. More specifically, the offset indentations are oriented at an angle between about 7.5 degrees and about 45 degrees from the sleeve axis. The indentations can be arranged in a linear fashion or a curvilinear fashion. Each offset indentation in an embodiment is contemplated to be generally circular. Other shapes may be considered as usable herein.

Each of the offset indentations is oriented a distance away from an adjacent indentation a distance that is equivalent to about ½ the diameter of the adjacent indentation. The offset indentations have diameters that range between about 3/20 inches and about ¾ inches. However, all diameters for offset indentations on a sleeve can be the same diameter in an embodiment. In another embodiment, some of the diameters can be larger than other diameters and still be usable here.

For example, for a sleeve about 6 inches in width, and about 2.66 inches long, it is contemplated to have about 52 offset indentations formed in the outer side of the sleeve. Each offset indentation is contemplated to be round in one embodiment, but the offset indentations could also have an elliptical shape. It is contemplated that between about 4 rows and about 8 rows of the offset indentations are used on each sleeve, depending on the size and use of the sleeve.

Specifically, for a six inch sleeve, it is contemplated that the offset indentations are oriented diagonally in rows of 6 offset indentations around the 6 inch sleeve. The diameter is about ½ inch. That is, a second indentation is formed diagonal to the first indentation at a distance about ½ the diameter of the adjacent offset indentation.

For larger casing savers, there may be more rows than 6, or there may be larger diameter offset indentations.

Offset indentations preferably have consistent depths for each sleeve. Depending on the size of the sleeve, the offset indentations can range in depth between about 3/20 inches and about ¾ inches.

The offset indentations can have a preferred diameter ranging from about ¼ inches to about 1 inch for a 6.7 inch outer diameter (OD) sleeve.

A plurality of a metal carbide inserts are inserted into each offset indentation. Each metal carbide insert can have at least one knurl for providing an interference fit into an offset indentation. A knurl is a ridge from the top to the bottom of the insert, and they can be 1/16 inch wide peak, then a 1/16 inch valley all around the insert. More than 1 knurl can be usable herein per metal carbide insert. More than 1 knurl provides an interference fit into the offset indentation. It is contemplated that one metal carbide insert, such as a tungsten carbide insert is used per offset indentation.

The metal carbide inserts are inserted into the offset indentations to form a wear resistant pad around the sleeve.

The wear resistant pad, which is not a complete coating on the sleeve surface, in a preferred embodiment, absorbs a substantial portion of the friction from the walls of the borehole preventing degradation of the sub body due to friction while drilling equipment turns.

At least one spring locking apparatus, and up to three such locking apparatus, are contemplated for use to hold the sleeve to the body forming the sub assembly.

It is contemplated that the body will have locking indentations formed in the body that correspond to the spring locking apparatus.

These spring locking apparatus can be purchased from Granger or other industrial supply houses.

These embodiments can be usable with subs, tool joints, pieces of workover equipment, or combinations of these devices.

In an embodiment, individual metal carbide inserts can be easily replaced if they fly off the sleeve during drilling. The invention allows groups of metal carbide inserts to be easily replaced in the case of uneven wear. Additionally, as all the metal carbide inserts wear out, all can be replaced on the drill floor without welding or the need for special training by a drilling hand or roughneck. Alternatively, the entire wear sleeve can be replaced easily and quickly by the drilling hand.

The metal carbide inserts are contemplated to be made from tough metals. For example, the metal carbide insert can be a tungsten carbide insert with about 8 percent to about 12 percent cobalt and the balance of the metal carbide insert being a tungsten carbide. The metal carbide inserts can be made of numerous alloys that provide substantial wear properties.

A feature of this device is that a first sleeve with a set of inserts could be used for certain types of friction, and then replaced to a second sleeve with a different set of inserts depending on the level of protection desired for the sub body.

The versatility of this device is very unique, and easy to use.

The metal carbide inserts are contemplated to be cylindrical in shape, or domed with a half circle. If the metal inserts are domed, it is contemplated that the dome can rise about 1/10 inch to about 1/4 inch above the sleeve forming a "button" over the sleeve. By having enough of these "buttons" and them being thick enough, a wear resistant pad is formed on the outside of the sleeve.

The sleeve is contemplated to have has an inner diameter between about 2 inches to about 10 inches.

Still another benefit of these embodiments, the metal carbide inserts do not need to be precisely fit into the indentations. This device enables less skilled workers to make and use the invention which is a significant cost saving to known devices.

In an embodiment, the invention contemplates using knurls metal inserts to get around the fine tolerances required for interference fits. The metal carbide inserts can be pushed into the offset indentations in the sleeve. When the metal carbide insert is pressed in, the carbide which is harder than the softer sleeve metal, deforms the sleeve metal. The metal carbide insert is then locked into place without need for a fastener or welding.

A benefit of the invention is in using the diagonal "offset" pattern for the offset indentations with metal carbide inserts. This diagonal pattern to the sleeve axis requires fewer metal carbide inserts than horizontal patterns, which again lowers the cost of manufacture of this device.

FIG. 1 shows an embodiment of a sub assembly (4) with a body (6) covered with a sleeve (10) held to the sub body using one of the plurality of spring locking apparatus (26*a*). The sleeve (10) is shown having a sleeve axis (11). Two or three spring locking apparatus are contemplated for use to engage locking indentations which can not be seen in this embodiment, on the body (6).

Figure 2:
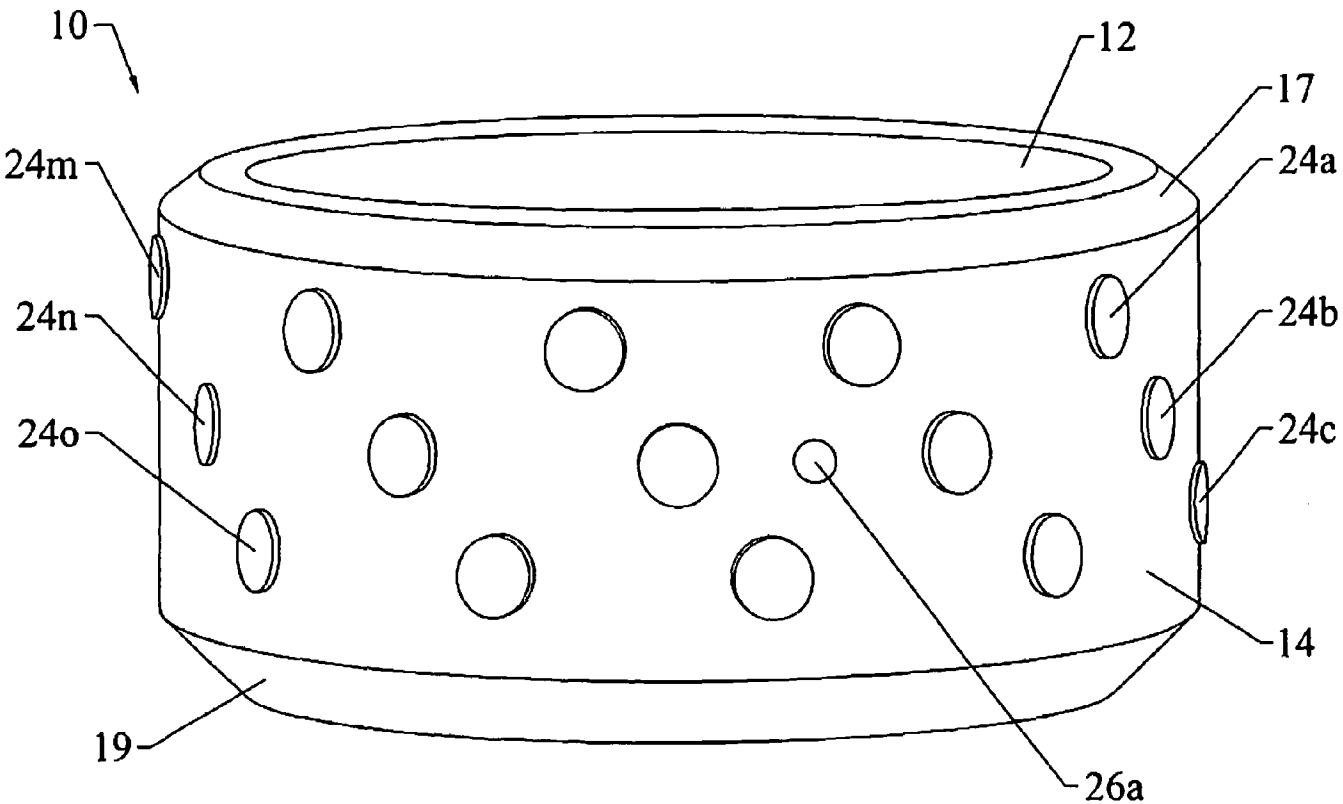
FIG. 2 depicts a detail of the sleeve.

This Figure shows the sleeve (10) having an outer side (14). FIG. 2, the perspective view of the sleeve (10), shows the sleeve (10) having an inner side (12) and the outer side (14).

The sleeve (10) securely engages the body (6) but in a removable manner. This removable engagement permits the outer side of the sleeve to receive a substantial portion of frictional wear from drilling of a borehole without damage to the body. The sleeve acts as a "casing saver".

The sleeve (10) is shown having a plurality of tungsten carbide inserts (24*a-i*) inserted in offset indentations (not shown in this Figure) forming the wear resistant pad (34).

The offset indentations engage the carbide metal inserts. In this embodiment, the offset indentations have identical diameters.

It is contemplated that the sleeve also has a sleeve outer diameter (15) which is slightly larger than the body outer diameter (9).

The sleeve (10) is also shown having a sleeve top square cut edge (17) opposite a sleeve bottom beveled edge (19) that fits within a groove 27, which is not is shown in this Figure, on the body. A sealing means (25), such a silicon gasket, can fit into the groove (27) on the body (6) and allow the sleeve to have a sealing engagement with the body (6).

FIG. 2 shows a detail of the sleeve (10) with the tungsten carbide inserts (24*a, b, c, d* and *e*) installed in a "X" pattern using linear rows diagonal to the sleeve axis. The outer side (14) and the inner side (12) of the sleeve (10) are also shown.

In this embodiment of FIG. 2, it is contemplated that each metal carbide insert is an insert that has a total weight of about 8 weight percent to about 12 weight percent cobalt over a tungsten carbide.

Figure 3:
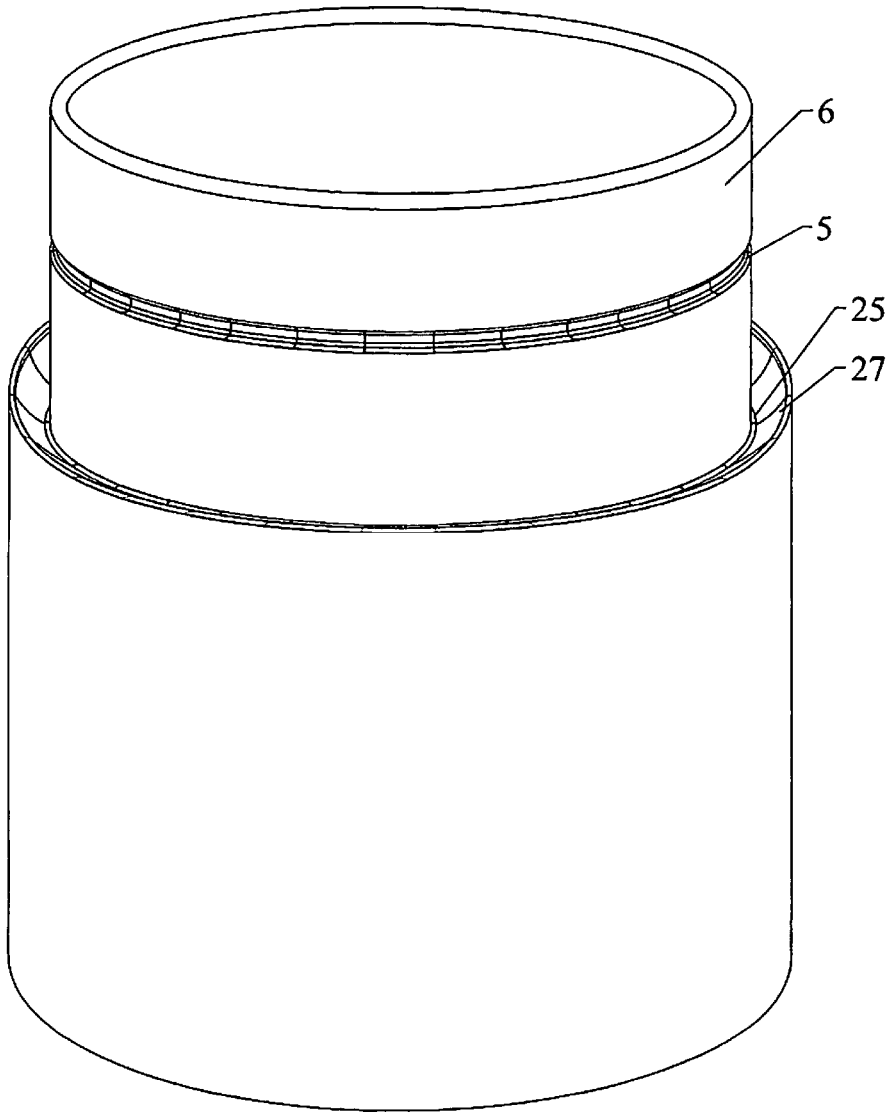
FIG. 3 shows a detail of the body of the sub assembly without the sleeve.

FIG. 3 shows a side view of a body (6) with two locking indentations (5*a*) and (5*b*) disposed on opposite sides of the body for engaging the spring locking apparatus of the sleeve (10).

FIG. 3 also shows the groove (27) into which the sleeve (10) can slide located on the body (6) and in that groove is a sealing means (25), which can be a gasket or another removable sealing material.

Figure 4:
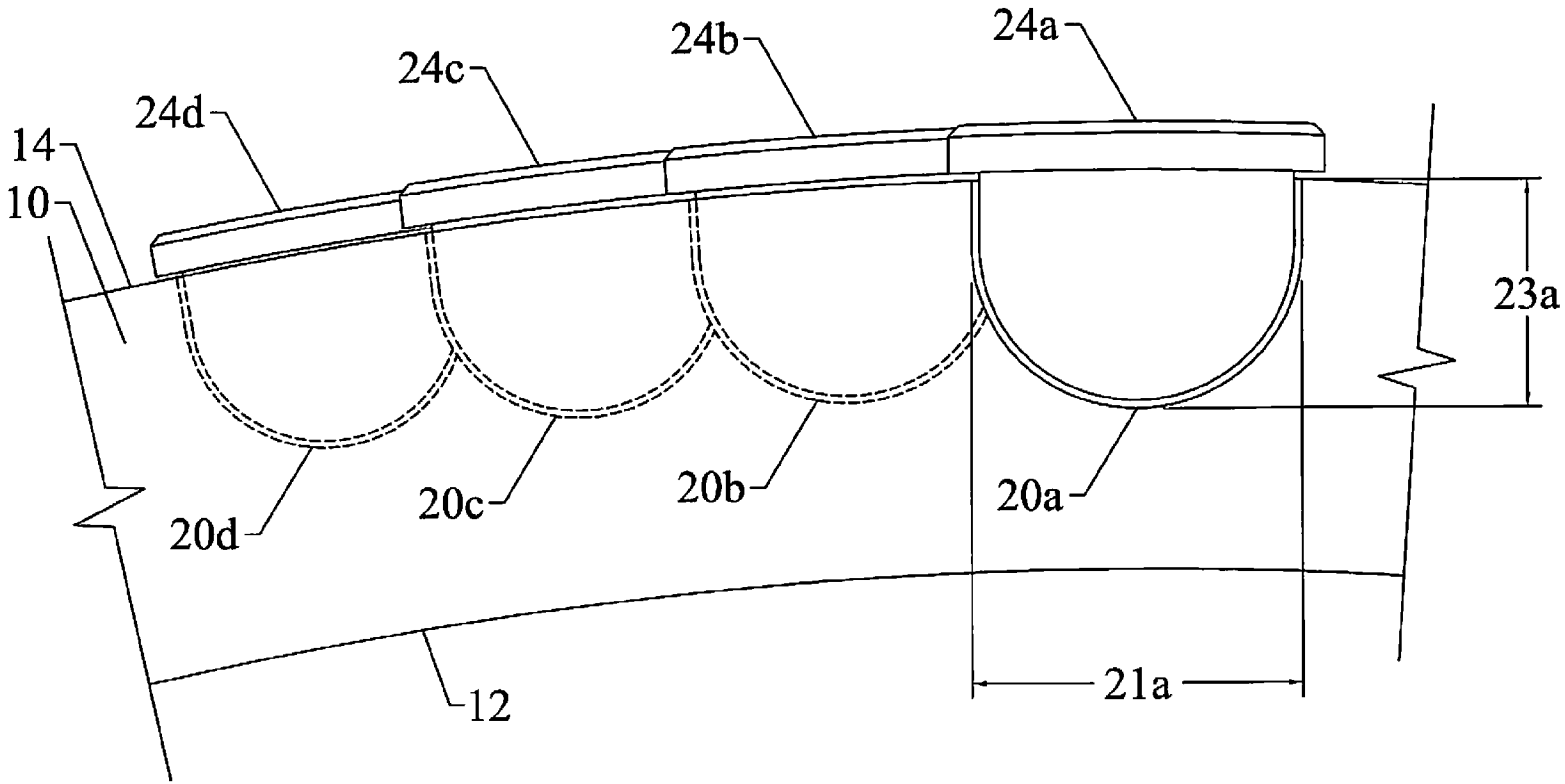
FIG. 4 depicts a cross sectional view of a sleeve with an metal carbide insert.

FIG. 4 shows a cut away view of a metal carbide insert engaging the sleeve and additional metal carbide inserts offset from the first insert. The tungsten carbide inserts (24*a*), (24*b*), (24*c*), and (24*d*) is part of the wear resistant pad (34) of the outer side (14) of the sleeve. The metal carbide inserts (24*a*), (24*b*), (24*c*), and (24*d*) have ridged surfaces providing a tight interference fit with at least 4 offset indentations (20*a*), (20*b*), (20*c*) and (20*d*). The offset indentation (20*a*) is depicted with an offset indentation diameter (21*a*) and an offset indentation depth (23*a*).

The tungsten carbide insert has a cap portion that extends above the offset indentation which in this view is shown as a dome cap. The cap can also be square, rectangular or another shape.

The metal inserts can have a cylindrical metal body or can be more "T" shaped, and have a dome cap. The dome can rise about 1/10 inch to about 1/4 inch above the outer side of the sleeve.

While these embodiments have been described with emphasis on the embodiments, it should be understood that within the scope of the appended claims, the embodiments might be practiced other than as specifically described herein.

What is claimed is:

1. An apparatus for protecting a subassembly with a body having a body outer diameter inside a borehole of a well, comprising:

a sleeve having a sleeve axis, an inner side and an outer side and a sleeve outer diameter larger than the body outer diameter, further wherein the sleeve has a sleeve top square cut edge and a sleeve bottom beveled edge;

a plurality of offset indentations each having a offset indentation diameter formed on the outer side of the sleeve, wherein each offset indentation has an offset indentation depth between about 3/20 inches to about 3/4 inches, and the plurality of offset indentations are formed in rows of 4 to 8 offset indentations along an angle sloping from about 7.5 degrees to about 45 degrees from the sleeve axis;

a plurality of a metal carbide inserts providing an interference fit into each offset indentation thereby forming a wear resistant pad on the outer side of the sleeve;

a sealing means disposed between the sleeve bottom beveled edge and the body; and at least two spring locking apparatus disposed in the sleeve, wherein each spring locking apparatus engages a locking indentation on the body forming a sealed protected sub assembly.

2. The apparatus of claim 1, wherein the sealed protected sub assembly is tubular shape.

3. The apparatus of claim 1, wherein the wear resistant pad provides a 100 percent wear resistance using metal carbide inserts covering the sleeve.

4. The apparatus of claim 1, wherein each of the offset indentations is oriented a distance away from an adjacent offset indentation at a distance equivalent to about 1/2 the diameter of the adjacent offset indentation.

5. The apparatus of claim 1, wherein the offset indentations have a diameter ranging between about 3/20 inches to about 3/4 inches.

6. The apparatus of claim 1, wherein the metal carbide insert is a tungsten carbide insert.

7. The apparatus of claim 1, wherein the metal carbide inserts are cylindrical, or domed in shape.

8. The apparatus of claim 1, wherein the sleeve has an inner diameter between about 4.5 inches to about 10 inches.

* * * * *